United States Patent [19]

Brookes et al.

[11] Patent Number: 4,859,318

[45] Date of Patent: Aug. 22, 1989

[54] RECOVERING COAL FINES

[75] Inventors: Gerald F. Brookes, Cotgrave; Lynne Spencer, Alvaston, both of England

[73] Assignee: Fospur Limited, Derbyshire, England

[21] Appl. No.: 109,036

[22] Filed: Oct. 16, 1987

[51] Int. Cl.[4] ..... B03D 1/02

[52] U.S. Cl. ..... 209/166; 209/5; 252/61

[58] Field of Search ..... 209/5, 166, 167; 44/1 R, 15 R, 625, 627; 252/61

[56] References Cited

U.S. PATENT DOCUMENTS

| | | | |
|---|---|---|---|
| 4,126,426 | 11/1978 | Vershuur | 209/5 |
| 4,248,697 | 2/1981 | Halvorsen | 209/5 |
| 4,270,926 | 6/1981 | Burk, Jr. | 209/166 |
| 4,304,573 | 12/1981 | Burgess et al. | 209/166 |
| 4,326,855 | 4/1982 | Cottell | 209/5 |
| 4,340,467 | 7/1982 | Wang | 209/166 |
| 4,415,337 | 11/1983 | Kuha | 44/24 |
| 4,437,861 | 3/1984 | Ishizuka et al. | 209/5 |
| 4,448,585 | 5/1984 | Yoo | 209/166 |
| 4,466,887 | 8/1984 | Gross | 209/166 |
| 4,526,680 | 7/1985 | Owen | 209/166 |
| 4,532,032 | 7/1985 | Ng et al. | 209/166 |
| 4,564,369 | 1/1986 | Burgess | 44/2 |
| 4,589,980 | 5/1986 | Keys | 252/61 |
| 4,618,414 | 10/1986 | Hartan et al. . | |

FOREIGN PATENT DOCUMENTS

| | | | |
|---|---|---|---|
| 23073 | 6/1972 | Australia . | |
| 1201223 | 2/1986 | Canada | 209/166 |
| 0020275 | 12/1980 | European Pat. Off. . | |
| 0166897 | 1/1986 | European Pat. Off. . | |
| 104569 | 1/1979 | Poland | 209/166 |
| 732018 | 5/1980 | U.S.S.R. | 209/166 |
| 953550 | 3/1964 | United Kingdom . | |
| 957724 | 5/1964 | United Kingdom . | |
| 10415477 | 9/1966 | United Kingdom . | |
| 1110643 | 4/1968 | United Kingdom . | |
| 1114820 | 5/1968 | United Kingdom | 209/166 |
| 2111866 | 7/1983 | United Kingdom | 209/166 |
| 2143155 | 2/1985 | United Kingdom | 209/166 |
| 2171919A | 9/1986 | United Kingdom . | |
| 2156243B | 4/1987 | United Kingdom . | |
| 2157980B | 4/1987 | United Kingdom . | |
| 2182587A | 5/1987 | United Kingdom . | |
| 2163976B | 9/1988 | United Kingdom . | |

OTHER PUBLICATIONS

"Condensed Chemical Dictionary" p. 916, 6th Edition Rhenhold Publ. ©1961 Edited by Arthur & Eliz. Rose.

"Separation of Ultrafine Pyrite from High Sulfur Coal by Selective Disperson and Flocculation" by Attia–Fossil Fuels Utilization.

Brookes, G. F. et al, "The Selective Flocculation of Coal/Shale Mixtures Using Commercial . . . " XIV International Mineral Processing Center, Oct. 17–23 1982, Toronto, Canada, VII–7.1–VII—7.16.

*Primary Examiner*—Kenneth M. Schor

*Assistant Examiner*—Thomas M. Lithgow

*Attorney, Agent, or Firm*—Nixon & Vanderhye

[57] ABSTRACT

Coal fines are recovered from an aqueous slurry which also contains shale as suspended fine solids by adding to the slurry a hydrophobic polymer such as a polybutadiene or a polyvinylether in a liquid organic carrier such as gas oil, diesel oil or kerosene, agitating the resulting mixture, introducing gas such as air into the mixture to form bubbles whereby flocs of coal fines formed are caused to float, and discarding the underlying slurry containing shale. To aid solution of the polymer a co-solvent, such as an aromatic solvent or a paraffinic solvent, compatible with the carrier may be used. The method is preferably carried out as a froth flotation in a froth flotation cell using a conventional frother such as methyl isobutyl carbinol or a mixture of polypropylene glycol ethers in addition to the polymer and carrier.

13 Claims, No Drawings

RECOVERING COAL FINES

This invention concerns recovering coal from aqueous slurries of coal fines also containing associated impurities as suspended fine solids and compositions for use in the recovery process.

Coal as mined (run-of-mine coal) contains a proportion of impurities (hereinafter called 'shale') and, in the case of the fine particles present, separation of the coal from the shale presents considerable problems. In the case of mines where modern, mechanical extraction techniques are used, typically a proportion as high as about 20% of the run-of-mine coal consists of particles smaller than 0.5 mm. This fine 'coal' typically has a substantial coal content but also a substantial shale content so it is important to make use of the coal content but also to remove shale from it. Modern coal preparation processes result in the fines (separated from coarser material) being in the form of aqueous slurries.

In the United Kingdom the usual way of separating coal fines from shale fines in aqueous slurries is by means of froth flotation followed by filtration. However, the efficiency of this process is seriously affected by the presence of ultra-fine (of less than about 50 microns) matter (both coal and shale), often present in significant proportions in the material requiring treatment.

When froth flotation is not used, the usual separation technique applied to the aqueous slurry of fines is to pass the slurry through a hydrocyclone and then feed the hydrocyclone underflow to a screen having apertures of about 0.25 mm. The 'product' i.e. coal fines with a reduced proportion of shale fines is the matter retained by the screen whilst the hydrocyclone overflow and the matter passing through the screen are discarded. A consequent disadvantage is that the significant proportion of the coal having particle sizes below 0.25 mm is lost.

Another technique that has been proposed for separating coal fines from shale fines in aqueous slurries is oil agglomeration. In this process coal fines are selectively agglomerated, with respect to shale fines, by use of an oil 'binder' and the coal agglomerates are then separated from the shale fines by a screening or classification process. However, the process has the disadvantage of requiring a substantial proportion of oil in relation to the solids in the slurry being treated.

According to one aspect of the present invention a method of recovering coal fines from an aqueous slurry also containing shale as suspended fine solids comprises adding to the slurry a hydrophobic polymer in a liquid, organic carrier, agitating the mixture, introducing gas into the mixture to form bubbles whereby flocs of coal fines formed are caused to float and discarding the underlying slurry containing shale.

It has been found in accordance with the invention that coal fines can be flocculated efficiently by use of hydrophobic polymers and that the flocculation is highly selective for coal fines in preference to shale fines. Thus in the above method flocs of coal fines are formed selectively in preference to flocs of shale fines and a high degree of selectivity can be achieved. The agglomeration of the coal fines into flocs reduces the exposed surface area of the coal and thereby reduces entrainment of shale fines with the coal. Moreover, the coal fines can be formed into flocs of sufficient strength to survive vigorous agitation of the slurry and by agitation of the slurry the flocs of coal fines can be caused to 'extrude' shale fines and water that may initially have been entrained within the flocs.

It has been found that if gas is not introduced into the mixture and bubbles formed causing flocs of coal fines formed to float, little separation of coal and shale is achieved and the sediment contains coal and shale fines in proportion not greatly different from the original ones and there is little distinction between different levels of the sediment. It is thought that the reason for this is that as the flocs of coal fines descend in the slurry they entrain shale fines and thus the benefit of selective flocculation of the coal fines is lost to a greater or lesser extent. The introduction of the gas e.g. air and formation of the bubbles may be effected by sufficiently vigorous agitation of the mixture or a specific device may be used to introduce gas into the mixture and form the bubbles.

It is much preferred that the method of the invention should be performed as a froth flotation in a froth flotation cell, using, in addition to polymer and carrier, a frother, as used in conventional froth flotation processes. When the method is performed in this manner the organic liquid not only acts as a carrier for the polymer but it also acts as a so-called collector in the conventional froth flotation sense. When the method is conducted in this manner high selectivity is easily retained but with the advantage that greatly reduced dosage rates of polymer are effective. In the froth flotation form of the method, the polymer dosage may be as low as say 0.5 kg/tonne of slurry solids. Moreover as with the method in general, high yields are obtainable i.e. not only is the method highly selective as between coal fines and shale fines but also a high proportion of the coal fines, particularly those of very low particle sizes (less than about 50 microns) can be recovered.

A variety of hydrophobic polymers may be used but polybutadienes and polyvinylethers have been found to be particularly satisfactory in the case of the more aliphatic coals e.g. steam coals. In general polymers having aliphatic units are preferred in the case of the more aliphatic coals whilst for the more aromatic coals e.g. anthracite polymers having aromatic units are preferred as aliphatic polymers are less effective with such coals than they are with the more aliphatic coals. It is important that the polymer should be hydrophobic rather than merely contain a proportion of hydrophobic units. Whilst polymers containing ether linkages as in polyvinylethers are suitably hydrophobic, such polymers as polyacrylamides are hydrophilic and are of low selectivity for the flocculation of coal in preference to shale and such polymers as polyacrylic esters are also too hydrophilic.

Gas oil has been found to be a particularly satisfactory carrier for suitable polymers having aliphatic units. Examples of other carriers that may be used include diesel oil, and kerosene and other petroleum and coal-based distillates. To aid solution of the polymer in the liquid a co-solvent compatible with the carrier may be used. Examples of co-solvents that may be used include toluene, xylenes and other aromatic solvents and hexane and other paraffinic solvents. Co-solvents may be particularly useful if the polymer is of high molecular weight and/or if the polymer comprises aromatic units and the carrier is of mainly aliphatic character.

The efficiency of the method is dependent on the dosage rate of the polymer in relation to the solids in the slurry. In a simple form of the method (not involving froth flotation) some recovery of the coal fines may be achieved with a dosage rate as low as for example, 2.45 kg. polymer/tonne of slurry solids but under the same conditions an almost doubled dosage rate of 4.71 gave far superior results. The optimum dosage rate in any particular case is that just sufficient to cause effective flocculation of substantially all the coal fines. Whilst high selectivity may be retained with lesser rates, only partial recovery of the coal fines is then achievable. Rates higher than the optimum are simply wasteful of the polymer.

It has been found that it is not the liquid, organic carrier e.g. gas oil alone that yields the good results in the method of the invention. In general, if e.g. gas oil is used without a hydrophobic polymer, the selectivity is largely lost and in the case of a froth flotation method, use of gas oil and a conventional frother but no hydrophobic polymer results in a low yield i.e. the coal fines are not efficiently flocculated.

According to a further aspect of the invention, an additive composition for use in the froth flotation method of the invention comprises a hydrophobic polymer and a frother in a liquid, organic carrier. Preferably the composition comprises 5–25% of the polymer, 5–25% of frother and 50–90% of carrier, all by weight. The frother may be as in the known froth flotation process, and may be for example methyl isobutyl carbinol or a mixture of polypropylene glycol ethers available under the tradename TEEFROTH G. The composition is preferably used in an amount not greater than 10 kg per tonne of slurry solids, especially 0.5–5 kg per tonne.

The method of the invention gives rise to a secondary advantage in that the coal flocs formed are more readily filtered than coal fines which have not been flocculated. Moreover, not only can the filtration be carried out more quickly but also it gives rise to a coal residue having the advantage of a lower water content. These effects are thought to result from the formation of relatively large coal flocs having fully hydrophobic surfaces and low shale content.

The method of the invention is applicable to coal/-shale slurries of the types that in the past have been subjected to conventional froth flotation processes. In such slurries the size of the coal and shale particles is usually less than 500 microns and commonly up to 50% by weight of the particles can have sizes less than 50 microns.

The presence of substantial proportions of ultra-fine particles e.g. less than 50 microns seriously impairs the efficiency of the conventional froth flotation process. By use of a hydrocyclone a typical feed for a conventional froth flotation process can be split into two fractions, one containing particles of predominantly 50 microns and upwards and the other particles predominantly less than 50 microns. The fraction containing the larger particles may then be treated by a conventional froth flotation process with increased efficiency whilst the method of the invention is especially well suited to the treatment of the fraction containing the smaller particles.

The invention is illustrated by the following examples, in which some of the processes described are not according to the invention and are included for comparison purposes.

EXAMPLE 1

Experiments were carried out on a synthetic aqueous coal/shale slurry containing equal weights of coal and shale fines and having a solids content of 5% by weight. The ash content of the solids was 46% by weight. Of the solids, 80% by weight were of particle sizes less than 63 microns.

Three different treatment processes were applied to the slurry. In Process I the chosen additive was added to a sample of the slurry in a separating funnel and the mixture stirred at a low speed such that thorough mixing occurred but there was substantially no creation of air bubbles in the slurry. The stirring was then discontinued, solids allowed to sediment out, the sediment separated from the slurry above and both the sediment and the overlying slurry collected, the sediment returned to the funnel, water added and the resultant mixture again stirred slowly, the stirring again discontinued and solids again allowed to sediment out and the sediment separated from the overlying slurry and both collected. The sediment was filtered, dried and weighed (to determine the product yield of the process) and then burnt and reweighed (to determine the ash content of the product). The two portions of collected separated slurry were separately filtered and the residues dried, weighed and burnt (to determine their ash contents).

In Process II the above process was generally repeated but using high speed stirring such that numerous air bubbles were created in the slurry and caused solids to float rather than sediment out. Accordingly in this process on each of the two occasions the underlying slurry was separated from the floated-out solids rather than the sediment being separated from the overlying slurry.

In Process I and II sodium hexametaphosphate was included in the initial slurry as a shale dispersant at a concentration of 2.5% by weight.

In Process III the chosen additive was added to a sample of the slurry and the mixture then subjected to froth flotation using froth flotation apparatus of the Leeds cell design. The floated-out matter was separated from the underlying slurry and the latter collected and the former returned with added water to the Leeds cell which was then operated again. The floated-out matter was again separated from the underlying slurry and both collected. The floated-out matter was filtered, dried and weighed (to determine the product yield) and burnt and re-weighed (to determine the ash content of the product). The two portions of collected separated slurry were separately filtered and the residues dried, weighed and burnt.

The experimental data is given in Table 1.

TABLE 1

| | Additive (kg./tonne slurry solids) | | | | Product | | 1st Tailings | 2nd Tailings |
|---|---|---|---|---|---|---|---|---|
| Example | Polymer | Gas Oil | Frother | Process | Yield (%) | Ash (%) | ash (%) | ash (%) |
| 1.1 | 4.84(A25) | 10.62 | — | I | 37.9 | 23.47 | 63.3 | 47.6 |
| 1.2 | 4.15(I30) | 21.63 | — | I | 30.9 | 23.6 | 56.1 | 53.4 |
| 1.3 | 2.45(A25) | 5.39 | — | II | 13.3 | 5.45 | 52.2 | 69.9 |
| 1.4 | 4.71(A25) | 10.34 | — | II | 30.6 | 6.52 | 62.9 | 84.2 |
| 1.5 | 4.04(I30) | 20.98 | — | II | 51.0 | 7.56 | 85.9 | 86.2 |

TABLE 1-continued

| Example | Additive (kg./tonne slurry solids) Polymer | Gas Oil | Frother | Process | Product Yield (%) | Ash (%) | 1st Tailings ash (%) | 2nd Tailings ash (%) |
|---|---|---|---|---|---|---|---|---|
| 1.6 | — | 25 | — | II | 55.6 | 24.4 | 74.1 | 59.8 |
| 1.7 | 0.53(A25) | 1.17 | 0.2 | III | 52.8 | 9.01 | 90.7 | 84.8 |
| 1.8 | 0.54(I30) | 2.80 | 0.2 | III | 48.6 | 6.24 | 89.8 | 63.8 |
| 1.9 | — | 3.33 | 0.2 | III | 34.2 | 7.78 | 79.3 | 34.3 |

In the Table 'A25' and 'I30' signify a polyvinyl ethyl ether and a polyvinyl isobutyl ether available under the tradenames Lutonal A25 and Lutonal I30 respectively from BASF United Kingdom Limited. These are hydrophobic polymers. In the Table 'frother' signifies the known frother methyl isobutyl carbinol. First and second 'tailings' in the Table refer to the solids respectively in the initially and subsequently separated slurries. In connection with the figures for 'yield', it should be noted that the theoretical maximum for the yield of coal is 50%, as half the weight of the initial slurry solids is coal and the other half shale.

Example 1.6 in the Table is shown as being conducted according to Process I. However, although high speed stirring was used such that numerous air bubbles were created in the slurry, the solids sedimented out rather than floated and thus the separation steps were conducted in accordance with Process I rather than Process II.

Examples 1.1 and 1.2, which use Process I, are included only for comparison purposes. The product ash contents are high, signifying a substantial proportion of shale in the product. Example 1.3, which uses Process II, gives a much lower ash content but the yield is low. Example 1.4, where the additive application rate is approximately doubled, gives a much higher yield but the ash content is still low. Examples 1.5, again using Process II, gives a good yield of low ash content and the high ash contents of the tailings signify that little coal is lost in the tailings. The contrast with Example 1.2 using Process I but otherwise generally similar is very marked.

Example 1.6 is included only for comparison purposes and shows that Process II is not effective in the absence of the polymer: whilst the product yield is high, the product has a high ash i.e. shale content.

Examples 1.7 and 1.8, using Process III, give good yields with low ash contents and in comparison with Examples 1.4 and 1.5, using Process II and also using the same polymers and gas oil, the application rates of the polymer and gas oil are very much lower.

Example 1.9, included only for comparison purposes, shows that if gas oil and frother are used in Process III without the polymer a greatly reduced yield results.

EXAMPLE 2

Process IV, which was the same as Process III described in Example 1 except that froth flotation was done once instead of twice, was carried out on an aqueous coal/shale slurry from a coal preparation plant using in one series of experiments an additive composition according to the invention and in another series of experiments the froth flotation oil in current use on the plant at the time.

The ash content of the solids in the slurry was 36.5% by weight, and of the solids 69% by weight were of particle size less than 53 microns.

The composition of the additive was, by weight:

60% gas oil

20% mixture of polypropylene glycol ethers (TEEFROTH G)

20% polyvinyl ethyl ether (LUTONAL A25)

A range of dosages comparable to normal practice was used for both the additive composition and the froth flotation oil, and in each experiment the flotation time was 180 seconds.

The results obtained are tabulated in Table 2 in which Combustible Recovery is defined as $$\frac{(100 - \text{Wt. \% Product Ash}) \times \text{Product Weight}}{(100 - \text{Wt. \% Feed Ash}) \times \text{Feed Weight}} \times 100$$

TABLE 2

| | Dosage (kg/tonne) | Product Ash wt % | Yield wt % | Combustible Recovery wt % | Tails Ash wt % |
|---|---|---|---|---|---|
| Additive Composition | 0.82 | 14.3 | 16.4 | 21.9 | 40.1 |
| | 0.84 | 14.6 | 23.4 | 31.7 | 43.6 |
| | 1.16 | 15.4 | 43.5 | 58.5 | 54.6 |
| | 1.21 | 13.0 | 42.4 | 55.1 | 47.8 |
| | 1.43 | 15.3 | 52.8 | 69.1 | 57.6 |
| | 2.09 | 16.7 | 60.8 | 80.0 | 67.6 |
| Froth Flotation Oil | 0.67 | 17.6 | 21.9 | 27.9 | 40.5 |
| | 0.90 | 20.1 | 34.7 | 44.1 | 46.2 |
| | 1.04 | 20.6 | 39.5 | 49.3 | 46.7 |
| | 1.21 | 18.6 | 39.6 | 50.5 | 47.8 |
| | 1.49 | 20.3 | 46.8 | 57.9 | 48.9 |
| | 1.96 | 19.9 | 53.9 | 67.8 | 55.5 |

The results obtained using the additive composition are, over the range of dosages investigated, superior to those obtained using the conventional froth flotation oil, and particularly at high dosages are characterised by higher weight yields and lower product ash contents. For example at a dosage of 1.21 kg ash is reduced by 5.6% by weight and the yield increased by 2.8% by weight.

EXAMPLE 3

Process IV as described in Example 2 was carried out on a sample of particle size less than 105 microns screened from a run-of-mine coal/shale slurry in which the particle size of the solids was less than 500 microns. The ash content of the solids in the sample was 45% by weight. 86% by weight of the solids in the sample had a particle size of less than 20 microns and an ash content of 46.4% by weight, and the remaining 14% by weight contained 30% by weight ash.

The additive composition described in Example 2 was compared with a proprietary froth flotation oil used in a conventional froth flotation process.

The results obtained are tabulated in Table 3.

TABLE 3

| | Additive Composition | Froth Flotation Oil | Froth Flotation Oil |
|---|---|---|---|
| Dosage kg/tonne | 0.25 | 0.25 | 0.65 |
| Flotation Time (secs) | 120 | 360 | 120 |
| Product Ash (% wt) | 17.0 | 19.6 | 20.6 |
| Yield (% wt) | 54.0 | 34.0 | 45.2 |
| Tails Ash (% wt) | 80.9 | 60.2 | 68.9 |
| Combustible Recovery (% wt) | 83.6 | 51.0 | 67.0 |

Columns 2 and 3 of Table 3 represent optimum results for the additive composition and for the froth flotation oil respectively at a dosage level of 0.25 kg/tonne. The flotation time using the additive composition is lower but the additive composition also produces lower product ash and an appreciably higher yield. Column 4 shows that flotation time using the proprietary froth flotation oil can be reduced by increasing the amount of oil used. However, this results in an increase in the product ash, and the high yield value achieved using the additive composition is still not reached.

EXAMPLE 4

A bulk feed sample of a coal/shale slurry was screened at 500 microns. Part of the sample was retained for normal froth flotation for comparison purposes and the remainder was classified in a 5 cm hydrocyclone.

One part of the overflow from the cyclone was subjected to froth flotation using Process IV described in Example 2 and the additive composition described in Example 2, and another part of the overflow was similarly treated using the froth flotation oil normally used to treat the slurry in the mine.

The underflow was diluted with water to approximately 6% solids by weight and similar froth flotation treatments were carried out on portions of the diluted material to those carried out on the overflow material.

Froth flotation was also carried out on the retained screened feed sample using the froth flotation oil normally used to treat the particular coal/shale slurry in practice.

The results obtained are tabulated in Tables 4.1, 4.2 and 4.3. In the Tables AC signifies that the additive composition was used and FFO indicates that the froth flotation oil was used.

TABLE 4.1

| UNDERFLOW - AFTER 45 SECS FLOTATION | | | | |
|---|---|---|---|---|
| | DOSAGE (kg/tonne) | PRODUCT ASH (wt %) | YIELD (wt %) | COMBUSTIBLE RECOVERY (wt %) |
| FFO | 0.210 | 7.58 | 18.85 | 33.25 |
| AC | 0.356 | 12.02 | 48.27 | 76.76 |
| FFO | 0.360 | 9.47 | 47.78 | 74.88 |
| AC | 0.551 | 13.66 | 54.76 | 86.39 |
| FFO | 0.700 | 13.69 | 56.67 | 86.96 |
| AC | 0.724 | 14.25 | 55.78 | 87.33 |
| FFO | 0.860 | 18.30 | 56.77 | 88.78 |
| AC | 1.047 | 14.21 | 60.90 | 91.09 |

TABLE 4.2

| OVERFLOW - AFTER 45 SECS FLOTATION | | | | |
|---|---|---|---|---|
| | DOSAGE (kg/tonne) | PRODUCT ASH (wt %) | YIELD (wt %) | COMBUSTIBLE RECOVERY (wt %) |
| AC | 1.080 | 25.82 | 21.54 | 53.02 |
| FFO | 1.210 | 29.86 | 21.16 | 49.56 |
| AC | 1.560 | 27.67 | 24.28 | 58.84 |
| FFO | 1.600 | 30.92 | 23.15 | 53.56 |
| AC | 1.890 | 28.51 | 23.42 | 56.14 |
| FFO | 2.210 | 33.27 | 25.00 | 54.75 |
| AC | 2.480 | 29.34 | 26.44 | 62.63 |
| FFO | 2.750 | 32.58 | 25.81 | 57.95 |
| AC | 3.560 | 32.91 | 31.53 | 67.51 |

TABLE 4.3

| COMPARISON OF SCREENED FEED AND UNDERFLOW USING FROTH FLOTATION OIL | | | | | |
|---|---|---|---|---|---|
| | DOSAGE (kg/tonne) | FLOTATION TIME (s) | PRODUCT ASH (wt %) | YIELD (wt %) | COMBUSTIBLE RECOVERY (wt %) |
| UNDERFLOW | 0.210 | 45 | 7.58 | 18.85 | 33.25 |
| FEED | 0.300 | 90 | 17.18 | 32.99 | 66.58 |
| UNDERFLOW | 0.360 | 45 | 9.47 | 47.78 | 74.88 |
| FEED | 0.500 | 90 | 21.71 | 43.39 | 82.07 |
| UNDERFLOW | 0.700 | 45 | 13.69 | 56.67 | 86.96 |
| FEED | 0.730 | 90 | 25.07 | 47.42 | 84.97 |
| UNDERFLOW | 0.860 | 45 | 18.30 | 56.77 | 88.78 |

The results demonstrate the benefits to be obtained by using a hydrocyclone to split the feed for a conventional froth flotation into one fraction containing fine particles of a size predominantly less than 50 microns (overflow) and another fraction containing relatively coarse particles of a size predominantly in the range of 50–500 microns (underflow) and then treating the fraction containing the fines by the method of the invention and the other fraction by a conventional froth flotation process.

For the underflow froth flotation using the additive composition of the invention gave similar results to the conventional froth flotation using the froth flotation oil except at a high dosage level (greater than about 0.8 kg/tonne) at which level the additive composition produced a lower ash product. For the overflow while product ash levels remained relatively high using either the additive composition or the froth flotation oil, the ash contents were up to 4% lower using the additive composition and weight yields were in general improved. The results in Table 4.3 show that the conventional froth flotation applied to the cyclone underflow i.e. feed slurry from which fine particles have been removed is more efficient at lower dosages of froth flotation oil than froth flotation applied to unclassified feed slurry.

We claim:

1. A method of recovering coal fines from an aqueous slurry also containing shale fines as suspended fine solids, the method comprising forming a resultant slurry by adding to the slurry a hydrophobic polyvinyl ether in a liquid organic carrier in an amount sufficient to selectively form flocs of coal fines, agitating the resultant slurry containing said flocs of coal fines, introducing gas into the agitated resultant slurry to form bubbles whereby said flocs of coal fines formed are caused to float and recovering the floated coal fines while discarding the underlying slurry containing shale fines.

2. A method according to claim 1, wherein the hydrophobic polyvinyl ether is a polyvinyl ethyl ether.

3. A method according to claim 1, wherein the hydrophobic polyvinyl ether is a polyvinyl isobutyl ether.

4. A method according to claim 1, wherein the liquid organic carrier is gas oil, diesel oil or kerosene.

5. A method according to claim 1, wherein the carrier is a solvent for the hydrophobic polyvinyl ether and wherein a co-solvent compatible with the carrier is used to aid solution of the hydrophobic polyvinyl ether in said solvents.

6. A method according to claim 5, wherein the co-solvent is an aromatic solvent.

7. A method according to claim 6, wherein the aromatic solvent is toluene or xylene.

8. A method according to claim 5, wherein the co-solvent is a paraffinic solvent.

9. A method according to claim 8, wherein the paraffinic solvent is hexane.

10. A method according to claim 1, wherein a frother is used in said gas introducing step and the method is performed as a froth flotation in a froth flotation cell.

11. A method according to claim 10, wherein the frother is methyl isobutyl carbinol or a mixture of polypropylene glycol ethers.

12. A method according to claim 10, wherein said polyvinyl ether, said organic carrier and said frother are in the form of an additive composition comprising 14 25% by weight of said hydrophobic polyvinyl ether, 5–25% by weight of frother and 50–90% by weight of liquid organic carriers, and said additive composition is used in said froth flotation at up to 10 kg per tonne of slurry solids.

13. A method according to claim 12, wherein the additive composition is used in said froth flotation at 0.5–5 kg per tonne of slurry solids.

* * * * *